US009869002B2

(12) United States Patent
Park et al.

(10) Patent No.: US 9,869,002 B2
(45) Date of Patent: Jan. 16, 2018

(54) METHOD FOR MANUFACTURING DUPLEX STAINLESS STEEL SHEET HAVING REDUCED INCLUSIONS

(71) Applicant: POSCO, Pohang-si (KR)

(72) Inventors: Sung Jin Park, Pohang-si (KR); Man Jin Ha, Pohang-si (KR); Dae Sung Lee, Pohang-si (KR)

(73) Assignee: POSCO, Pohang-si (KR)

( * ) Notice: Subject to any disclaimer, the term of this patent is extended or adjusted under 35 U.S.C. 154(b) by 113 days.

(21) Appl. No.: 14/962,424

(22) Filed: Dec. 8, 2015

(65) Prior Publication Data

US 2016/0168655 A1 Jun. 16, 2016

(30) Foreign Application Priority Data

Dec. 11, 2014 (KR) ..... 10-2014-0178294

(51) Int. Cl.

| | |
|---|---|
| ***C21C 7/06*** | (2006.01) |
| ***C21D 3/04*** | (2006.01) |
| ***C22C 38/58*** | (2006.01) |
| ***C22C 38/42*** | (2006.01) |
| ***C22C 38/02*** | (2006.01) |
| ***C22C 38/00*** | (2006.01) |
| ***C21C 5/00*** | (2006.01) |
| ***C21C 7/00*** | (2006.01) |
| ***C21C 7/064*** | (2006.01) |
| ***C21C 7/068*** | (2006.01) |
| *B22D 11/00* | (2006.01) |
| *B22D 11/06* | (2006.01) |

(52) U.S. Cl.

CPC ..... *C21D 3/04* (2013.01); *C21C 5/005* (2013.01); *C21C 7/0075* (2013.01); *C21C 7/0087* (2013.01); *C21C 7/06* (2013.01); *C21C 7/064* (2013.01); *C21C 7/0685* (2013.01); *C22C 38/001* (2013.01); *C22C 38/002* (2013.01); *C22C 38/02* (2013.01); *C22C 38/42* (2013.01); *C22C 38/58* (2013.01); *B22D 11/002* (2013.01); *B22D 11/0622* (2013.01)

(58) Field of Classification Search

None

See application file for complete search history.

(56) References Cited

U.S. PATENT DOCUMENTS

| | | | | |
|---|---|---|---|---|
| 2012/0009433 | A1 | 1/2012 | Hatano et al. | |
| 2014/0255244 | A1 | 9/2014 | Tsuge et al. | |
| 2016/0115574 | A1* | 4/2016 | Oliver | C22C 38/001 420/60 |

FOREIGN PATENT DOCUMENTS

| | | | |
|---|---|---|---|
| CN | 102021496 | | 4/2011 |
| CN | 102356173 | | 2/2012 |
| CN | 103987867 | | 8/2014 |
| CN | 104131237 | | 11/2014 |
| JP | 05337612 | | 12/1993 |
| KR | 20050014464 | A * | 2/2005 |
| KR | 20100045053 | | 5/2010 |
| KR | 20110006483 | | 1/2011 |
| KR | 101207662 | | 12/2012 |
| KR | 20130014923 | | 2/2013 |
| KR | 1020130071552 | | 7/2013 |
| KR | 1020140064941 | | 5/2014 |
| KR | 20140069945 | | 6/2014 |
| KR | 1020140082362 | | 7/2014 |

OTHER PUBLICATIONS

English Translation of KR 20050014464 from Espacenet, published Feb. 7, 2005.*

English Translation of KR 20100045053 from Espacenet, published May 3, 2010.*

English Translation of KR 20110006483 from Espacenet, published Jan. 20, 2011.*

Korean Office Action—Korean Application No. 10-2014-0178294 dated Feb. 4, 2016, citing KR 10-2013-0014923, KR 10-2010-0045053, KR 10-2014-0069945 and KR 10-2011-0006483.

* cited by examiner

*Primary Examiner* — George Wyszomierski

(74) *Attorney, Agent, or Firm* — Cantor Colburn LLP

(57) ABSTRACT

There is provided a method for manufacturing a duplex stainless steel sheet having reduced inclusions through argon oxygen decarburization (AOD), ladle treatment (LT), and twin roll strip casting. The method includes deoxidizing molten steel using silicon (Si) during the AOD, wherein the molten steel has a silicon (Si) content of 0.55 wt % to 0.75 wt % at the end of the AOD.

3 Claims, 2 Drawing Sheets

METHOD FOR MANUFACTURING DUPLEX STAINLESS STEEL SHEET HAVING REDUCED INCLUSIONS

CROSS-REFERENCE TO RELATED APPLICATION

This application claims the benefit of Korean Patent Application No. 10-2014-0178294 filed on Dec. 11, 2014, with the Korean Intellectual Property Office, the disclosure of which is incorporated herein by reference.

BACKGROUND

The present disclosure relates to a duplex stainless steel sheet, and more particularly, to a method for manufacturing a duplex stainless steel sheet having reduced inclusions through a twin roll strip casting process.

In general, a twin roll strip casting process refers to a process of directly and continuously producing a steel strip having a thickness of several millimeters (mm) from molten steel supplied between a pair of rotating casting rolls. Referring to FIG. 1, a twin roll strip caster 100 for twin roll strip casting generally includes casting rolls 110, a ladle 120, a tundish 130, a casting nozzle 140, a meniscus shield 150, brush rolls 160, and edge dams 170.

In a twin roll strip casting process, molten steel is supplied to the ladle 120, and the molten steel flows to the tundish 130 through a nozzle. Then, the molten steel is supplied from the tundish 130 to a region among the casting rolls 110 and the edge dams 170 attached to both ends of the casting rolls 110 through the casting nozzle 140, and the molten steel starts to solidify in the region. At this time, the meniscus shield 150 protects the surface of the molten steel solidifying in the region between the casting rolls 110 so as to prevent oxidation, and an appropriate gas is supplied to control the atmosphere of the region. In this state, while the molten steel solidifies, the molten steel is drawn from the region through a gap between the casting rolls 110 as a strip 180.

In such a twin roll strip casting process for directly producing a strip having a thickness of 10 mm or less, some techniques may be necessary to produce a strip having no cracks and a desired thickness at a high production rate by supplying molten steel through the casting nozzle 140 to the region between the casting rolls 110 rotating in opposite directions at high speed. However, fine inclusions may be formed in duplex stainless steel steels produced using the twin roll strip caster 100 because rapid solidification of molten steel does not allow for a sufficient time for inclusions to grow and combine with each other.

Such inclusions remaining on the surfaces of products may lead to surface damage or cracks and may act as sites lowering corrosion resistance. Particularly, non-metallic inclusions are inevitably formed during processes such as a molten steel deoxidizing process or a ferroalloy supplying process for temperature control. That is, although the formation of inclusions is inevitable, it is necessary to reduce or minimize the formation of inclusions.

SUMMARY

An aspect of the present disclosure may provide a method for manufacturing a duplex stainless steel sheet having reduced inclusions through a twin roll strip casting process.

According to an aspect of the present disclosure, there is provided a method for manufacturing a duplex stainless steel sheet having reduced inclusions through argon oxygen decarburization (AOD), ladle treatment (LT), and twin roll strip casting, the method including: deoxidizing molten steel using silicon (Si) during AOD, wherein the molten steel has a silicon (Si) content of 0.55 wt % to 0.75 wt % at the end of AOD.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
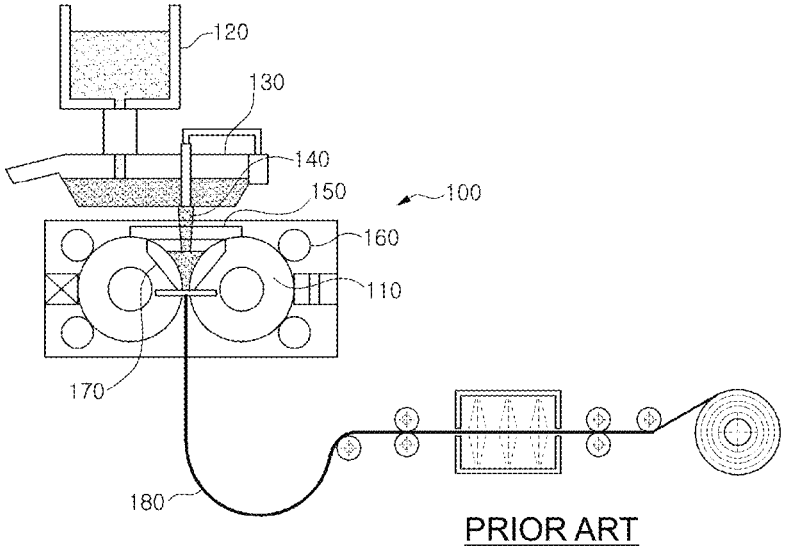
PRIOR ART FIG. 1
FIG. 1 is a schematic view illustrating a general twin roll strip caster.

Hereinafter, embodiments of the present inventive concept will be described as follows with reference to the attached drawings.

The present inventive concept may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" other elements would then be oriented "below," or "lower" the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein is for describing particular embodiments only and is not intended to be limiting of the present inventive concept. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present inventive concept will be described with reference to schematic views illustrating embodiments of the present inventive concept. In the drawings, for example, due to manufacturing techniques and/or tolerances, modifications of the shape shown may be estimated. Thus, embodiments of the present inventive concept should not be construed as being limited to the particular shapes of regions shown herein, for example, to include a change in shape results in manufacturing. The following embodiments may also be constituted by one or a combination thereof.

The contents of the present inventive concept described below may have a variety of configurations and propose only a required configuration herein, but are not limited thereto.

The present disclosure relates to a method for manufacturing a duplex stainless steel sheet having reduced inclusions through a twin roll strip casting process.

More particularly, the present disclosure relates to a method for manufacturing a duplex stainless steel sheet having reduced inclusions through general steel making processes: an argon oxygen decarburization (AOD) process, a ladle treatment (LT) process, and a twin roll strip casting process, while controlling conditions of the AOD process so as to decrease the number of inclusions of the duplex stainless steel sheet to a predetermined amount or less in the twin roll strip casting process.

According to the present disclosure, in the AOD process, molten steel is deoxidized using silicon (Si) without using aluminum (Al), and it may be preferable that the content of silicon (Si) in the molten steel be adjusted to be within the range of 0.55 wt % to 0.75 wt % when the AOD process is complete.

In the AOD process, decarburization, desulfurization caused by the formation of slag, and deoxidation take place. In the related art, since it is easy to reduce the amount of sulfur (S) through an active desulfurization reaction between calcium (Ca) and sulfur (S) if the amount of oxygen in steel is low, silicon (Si) and aluminum (Al) are added to deoxidize steel. The addition of aluminum (Al) in steel increases the content of alumina ($Al_2O_3$) in inclusions of the steel, leading to the formation of inclusions having a high melting point. Such inclusions having a high melting point are not easily separated as slag floating on molten steel but remain as slag in molten steel. The remaining slag has a low degree of basicity and is thus easily suspended in the molten steel, increasing the number of inclusions in the molten steel.

In the present disclosure, molten steel may be deoxidized by only adding silicon (Si) to the molten steel without adding aluminum (Al) to the molten steel, so as to solve the above-described problems. In addition, since deoxidation may occur insufficiently due to the absence of aluminum (Al), the content of silicon (Si) in the molten steel may be maintained at a high level compared to the case of related art so as to promote deoxidation, and thus the content of silicon (Si) may be within the range of 0.55 wt % to 0.75 wt % when the AOD process is complete.

During the AOD process, silicon (Si) may be added to the molten steel in the form of a ferroalloy (solid metal) containing silicon (Si). For example, in the AOD process, a silicon ferroalloy may be added to the molten steel by taking into consideration the solubility of silicon (Si) of the silicon ferroalloy in the molten steel and the purity of the silicon ferroalloy, and then the content of silicon (Si) in the molten steel may be determined by component analysis so as to maintain the content of silicon (Si) within the above-mentioned arrange when the AOD process is complete.

In the present disclosure, the content of silicon (Si) when the AOD process is complete does not refer to the content of silicon (Si) in a final product. That is, the content of silicon (Si) when the AOD process is complete refers to the content of silicon (Si) when the AOD process is completed in an AOD furnace. If the content of silicon (Si) in the molten steel is maintained within the range of 0.55 wt % to 0.75 wt % when the AOD process is complete, sufficient deoxidation may occur, and thus the content of oxygen in the molten steel may be reduced to a value required in the present disclosure, thereby reducing inclusions in a final product. In the LT process subsequent to the AOD process, silicon (Si) may be added. In this case, however, the addition of silicon (Si) is for adjusting the composition of a final product after deoxidation. That is, the addition of silicon (Si) subsequent to the AOD process has no effect on reducing inclusions.

If the content of silicon (Si) is less than 0.55 wt % when the AOD process is complete, mechanical properties of a final product may be degraded (for example, a decrease in elongation). If the content of silicon (Si) is greater than 0.75 wt % when the AOD process is complete, the following problems are experientially expected. That is, the high-temperature strength of a cast strip may increase because of a high content of silicon (Si), making the cast strip brittle and causing problems related to casting safety such as strip rupture. Therefore, it may be preferable that the content of silicon (Si) be maintained within the range of 0.55 wt % to 0.75 wt % until the end of the AOD process. Here, when molten steel having a silicon (Si) content of 1.1 wt % was cast, strip rupture occurred during casting, and thus, the content of silicon (Si) is limited to 1.0 wt % or less.

The duplex stainless steel sheet of the present disclosure may include, by wt %, carbon (C): 0.02% to 0.06%, silicon (Si): 0.55% to 0.75%, manganese (Mn): 2.8% to 3.2%, phosphorus (P): 0.035% or less, sulfur (S): 0.003% or less, chromium (Cr): 19.0% to 21.0%, nickel (Ni): 0.5% to 1.5%, copper (Cu): 0.3% to 1.2%, nitrogen (N): 0.2% to 0.28%, and a balance of iron (Fe) and inevitable impurities.

The composition of the duplex stainless steel sheet of the present disclosure includes reduced amounts of molybdenum (Mo) and nickel (Ni) and increased amounts of manganese (Mn) and nitrogen (N) compared to duplex stainless steel sheets of the related art, and thus the mechanical properties of the duplex stainless steel sheet may be improved. In addition, copper (Cu) added to the duplex stainless steel sheet of the present disclosure guarantees corrosion resistance.

Since the duplex stainless steel sheet includes the above-mentioned alloying elements within the above-mentioned content ranges, a microstructure including ferrite and austenite may be formed in the duplex stainless steel sheet, and the duplex stainless steel sheet having satisfactory properties may be manufactured with low costs.

An aspect of the present disclosure is to reduce inclusions in duplex stainless steel. Although duplex stainless steel is required to have a high degree of corrosion resistance, many inclusions affecting corrosion resistance are included in duplex stainless steel, and thus the method of the present disclosure is provided to reduce the number of inclusions in duplex stainless steel. In the present disclosure, the above-described composition of the duplex stainless steel sheet is not for reducing the number of inclusions. That is, the method of the present disclosure is not limited to manufacturing a duplex stainless steel sheet having the above-described composition but may be applied to the manufacturing of a duplex stainless steel sheet having any composition.

Furthermore, according to the present disclosure, it may be preferable that the basicity of slag in the AOD process be maintained within the range of 2.2 to 2.5.

During the AOD process, the basicity of slag may increase as the addition of quicklime (CaO) and silicon dioxide ($SiO_2$) increases, and thus the viscosity and melting point of the slag may increase. If the viscosity and melting point of slag increase as described above, the slag may be suspended in the molten steel, and thus the amount of slag absorbed in the molten steel may increase. The absorbed slag may be converted into inclusions and remain in later processes.

However, if the basicity of slag is maintained within the range of 2.2 to 2.5, an interface reaction occurring between the molten steel and the slag may decrease the equilibrium oxygen content of the molten steel, and thus inclusions may be reduced.

The basicity of slag refers to the ratio of $CaO/SiO_2$ (weight percentage ratio of $CaO/SiO_2$). $SiO_2$ is an oxide produced while the molten steel is deoxidized by the silicon ferroalloy added in the AOD process, and the amount of $SiO_2$ in the molten steel may be adjusted by the amounts of silicon (Si) and $O_2$ gas. The amount of CaO in the molten steel may be adjusted by the amount of CaO (quicklime) added to control basicity. In this manner, the basicity of slag ($CaO/SiO_2$) may be adjusted.

The basicity of slag is determined according to an equilibrium relationship among the contents of dissolved oxygen, silicon (Si), and aluminum in the molten steel. For example, as the content of silicon (Si) and the basicity of slag in the molten steel increase, the content of dissolved oxygen in the molten steel may decrease. If the basicity of slag is excessively low, the equilibrium oxygen content of the molten steel may increase, and thus inclusions may increase. Conversely, if the basicity of slag is excessively high, the content of oxygen in the molten steel may decrease, and thus the formation of inclusions by an oxidation reaction may reduce. In this case, however, the amount of aluminum (Al) in the molten steel may increase by the supply of alumina ($Al_2O_3$) from impurities of a raw material and ladle refractory materials, thereby causing surface defects of a final product. If the basicity of slag is less than 2.2, the equilibrium oxygen content in the molten steel may increase, and thus the formation of inclusions may increase. Conversely, if the basicity of slag is greater than 2.5, the reaction between slag and ladle refractory materials may increase to cause melting damage to refractory materials and the introduction of alumina ($Al_2O_3$) having a high melting point from the refractory materials, and thus surface defects may be formed on a final product. Therefore, according to the present disclosure, it may be preferable that the basicity of slag be within the range of 2.2 to 2.5 in the AOD process.

According to the present disclosure, in the LT process, the molten steel may be sampled in the form of disks for checking the composition of the molten steel. If disk-shaped samples are prepared as described above, sampling errors may decrease, and the LT process may be performed in a relatively short time.

Figure 2:
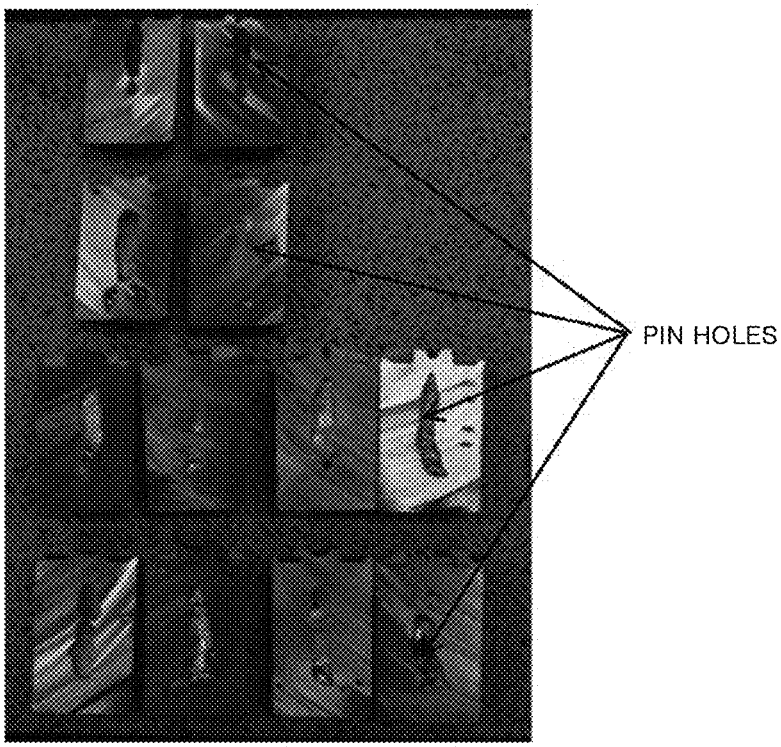
PRIOR ART FIG. 2
FIG. 2 is a view illustrating pin hole defects formed in cylindrical samples of high nitrogen duplex stainless steel of the related art collected by molten steel sampling.

FIG. 2 illustrates pin hole defects formed in cylindrical samples of high nitrogen duplex stainless steel of the related art, the cylindrical samples being collected by molten steel sampling. Because of the characteristics of high nitrogen duplex stainless steel, nitrogen supersaturated in molten steel is released from the molten steel as nitrogen gas as the solubility of nitrogen in the molten steel decreases along with solidification of the molten steel, and the nitrogen gas may be discharged externally. However, some nitrogen gas remaining in the molten steel may be trapped in samples of the molten steel, and thus, gas defects such as pin holes may be formed in the samples. In the case of a sampler of the related art (cylinder type), molten steel samples are prepared by cutting in a horizontal direction to adjust the sizes of the samples, and sections of the samples are polished for analyzing the composition of molten steel. However, high nitrogen duplex stainless steel is likely to have gas defects such as pin holes, and it may be difficult to analyze the compositions of samples of high nitrogen duplex stainless steel having pin holes. In the related art, when molten steel sampling is performed on high nitrogen duplex stainless steel having a nitrogen content of about 0.25 wt % like the duplex stainless steel sheet of the present disclosure, the possibility of pin hole defects in samples of the high nitrogen duplex stainless steel is greater than 60%. That is, sampling may have to be performed several times for component analysis. Since an additional work time of about 10 minutes is necessary for each sampling, an LT process may be performed for a long time period.

Figure 3:
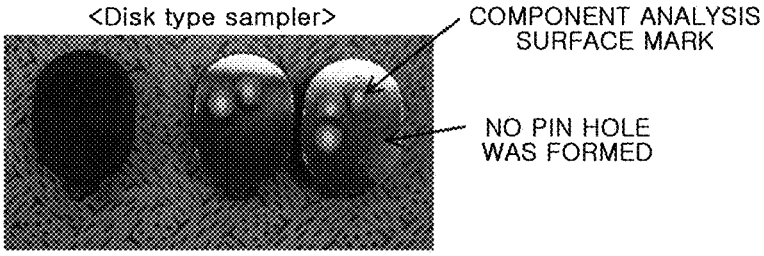
FIG. 3 is a view illustrating disk-shaped samples of high nitrogen duplex stainless steel of an exemplary embodiment of the present disclosure, the disk-shaped samples being collected by molten steel sampling.

However, if a molten steel sampler having a disk shape is used for high nitrogen duplex stainless steel as illustrated in FIG. 3, an error rate of 6% or less may be obtained. In the case of a sampler of the related art (cylinder type), molten steel samples are prepared by cutting in a horizontal direction to adjust the sizes of the samples, and sections of the samples are polished for analyzing the composition of molten steel. However, it may be difficult to analyze the composition of high nitrogen duplex stainless steel of the present disclosure by such a sampling method of the related art if internal nitrogen gas defects of samples are exposed externally. Therefore, an improved disk-type sampler including molds to properly adjust the size (height) of samples may be used to minimize the amount of nitrogen gas trapped in samples, and thus internal gas defects may be markedly reduced. In addition, component analysis may be performed after surface polishing (up to 5 mm) without horizontal cutting. Therefore, even though samples have gas defects, the gas defects may not be exposed externally of the samples, and thus component analysis may be performed on the samples without problems.

Therefore, in the LT process, disk-shaped samples may be prepared by molten steel sampling so as to check the composition of the molten steel, and errors caused by gas defects such as pin holes may be reduced to a rate of 6% or less. That is, the LT process may be stably performed, and in most cases, the composition of the molten steel may be checked by performing sampling once. In this manner, the LT process may be performed in a short time, and thus the temperature of the molten steel may be decreased when the molten steel is discharged from the AOD furnace. Since the temperature and oxygen content of the molten steel have a linear relationship, as the temperature of the molten steel decreases, the equilibrium oxygen content of the molten steel may also decrease. That is, the amount of oxygen causing the formation of oxides may be reduced in the molten steel, and thus the formation of inclusions may also be reduced.

Furthermore, according to the present disclosure, it may be preferable that the tapping temperature of the molten steel in the AOD process be maintained within the range of 1680° C. to 1710° C.

In an LT process of the related art, since the error rate of sampling by a conventional method is as high as described above, sampling may be performed several times, and thus the LT process may be performed for a long period of time. In the related art, therefore, molten steel having a high temperature of about 1750° C. is discharged in an AOD process to stably maintain the temperature of the molten steel in spite of the occurrence of sampling errors that increase the process time and manufacturing costs, and thus the equilibrium oxygen content in the molten steel increases. As a result, the number of inclusions may increase.

However, if a disk-shaped sampler is used as proposed in the present disclosure, sampling errors may decrease, and thus the LT process may be stably performed. That is, in most cases, the composition of the molten steel may be checked by performing sampling once. Therefore, the tapping temperature of the molten steel in the AOD process may be adjusted to be within the range of 1680° C. to 1710° C. As described above, since the temperature and oxygen content of the molten steel have a linear relationship, as the temperature of the molten steel decreases, the equilibrium oxygen content of the molten steel may also decrease. That is, the amount of oxygen causing the formation of oxides may be reduced in the molten steel, and thus the formation of inclusions may also be reduced. According to the present disclosure, the tapping temperature of the molten steel in the AOD process is adjusted to be 1710° C. or lower, that is, to be lower than the tapping temperature of molten steel in an AOD process of the related art. Therefore, the formation of inclusions may be reduced.

In the present disclosure, if the tapping temperature of the molten steel in the AOD process is lower than 1680° C., the equilibrium oxygen content of the molten steel may be further decreased. In this case, however, the tapping temperature of the molten steel is too low, and thus unstable casting may occur because the temperature of the molten steel may decrease to a very low level causing stagnation and surface solidification of the molten steel while the molten steel flows along an AOD furnace, a ladle treatment, a tundish, and a strip caster. Therefore, the tapping temperature of the molten steel may preferably be 1680° C. or higher. In addition, if the tapping temperature of the molten steel is higher than 1710° C., the equilibrium oxygen content of the molten steel may increase to promote the formation of inclusions. Therefore, it may be preferable that the tapping temperature of the molten steel in the AOD process be within the range of 1680° C. to 1710° C.

Hereinafter, the present disclosure will be described more specifically according to examples.

In examples of the present disclosure, high nitrogen duplex stainless steel S82121 having components as illustrated in Table 1 was used.

TABLE 1

| Steel | C | Si | Mn | P | S | Cr | Ni | Cu | N |
|---|---|---|---|---|---|---|---|---|---|
| S82121 | 0.0315 | 0.51 to 0.66 | 2.94 | 0.0216 | 0.0009 | 19.8 | 0.98 | 0.79 | 0.2405 |

Steel S82121 having components as illustrated in Table 1 was subjected to processes or treated in apparatuses in the following order: an electric arc furnace (EAF), a slag skimmer (skimming stand), an AOD furnace, a ladle treatment (LT) process (argon (Ar) bubbling), and a twin roll strip caster, so as to manufacture duplex stainless steel sheets. In the above, comparative samples and inventive samples were made while varying process conditions in the AOD furnace as illustrated in Table 2.

Inclusions in the comparative samples and the inventive samples were measured and analyzed by a method for analyzing non-metallic inclusions in a stainless steel sheet (thickness 2 mm) disclosed in Korean Patent Application Laid-open No.: 2011-0089560. The comparative samples and the inventive samples were prepared by cutting both end portions of the duplex stainless steel sheets inwardly from ends thereof at a ¼ position, a ½ position, and a ¾ position by 20 mm. Thereafter, the number of inclusions was measured over a total observation area of 200 mm from each of the comparative examples and the inventive examples.

TABLE 2

| | | Casting conditions | | | |
|---|---|---|---|---|---|
| No. | Casing No. | Si content (wt %) at the end of AOD process | Tapping temperature in AOD process (° C.) | Basicity ($CaO/SiO_2$) | Number of inclusions ($ea/cm^2$) |
| *CS1 | HR729 | 0.43 | 1738 | 1.95 | 266 |
| CS2 | HR754 | 0.47 | 1733 | 2.02 | 228 |
| CS3 | HR840 | 0.41 | 1744 | 2.05 | 193 |
| CS4 | HR893 | 0.39 | 1749 | 1.87 | 209 |
| **IS1 | HR976 | 0.66 | 1735 | 2.05 | 75 |
| IS2 | HR978 | 0.62 | 1741 | 2.11 | 71 |
| IS3 | HR988 | 0.64 | 1739 | 2.00 | 72 |
| IS4 | HR993 | 0.55 | 1738 | 1.98 | 81 |
| IS5 | HR999 | 0.51 | 1740 | 2.19 | 86 |
| IS6 | HR1000 | 0.56 | 1705 | 1.98 | 61 |
| IS7 | HR1001 | 0.58 | 1711 | 2.11 | 70 |
| IS8 | HR1003 | 0.56 | 1703 | 2.01 | 61 |
| IS9 | HR1007 | 0.58 | 1698 | 2.08 | 55 |
| IS10 | HR1017 | 0.59 | 1695 | 2.15 | 54 |
| IS11 | HR1022 | 0.61 | 1701 | 2.23 | 54 |
| IS12 | HR1034 | 0.60 | 1707 | 2.40 | 51 |
| IS13 | HR1037 | 0.61 | 1703 | 2.47 | 49 |

*CS: Comparative Sample,
**IS: Inventive Samples

Referring to Table 2, the number of inclusions per unit area of the Comparative Samples 1 to 4, each having a silicon content outside the range proposed in the present disclosure at the end of AOD process, was three or more times the number of inclusions per unit area of inventive samples. In addition, the number of inclusions per unit area of Inventive Samples 11 to 13 each having a silicon content at the end of an AOD process, and a molten steel tapping temperature and a slag basicity in the AOD process within the ranges proposed in the present disclosure was less than the number of inclusions per unit area of the other inventive samples.

As set forth above, according to exemplary embodiments of the present disclosure, duplex stainless steel sheets having reduced inclusions like stainless steel STS304 may be manufactured through a twin roll strip casting process.

While exemplary embodiments have been shown and described above, it will be apparent to those skilled in the art that modifications and variations could be made without departing from the scope of the present invention as defined by the appended claims.

What is claimed is:

1. A method for manufacturing a duplex stainless steel sheet, the method comprising: argon oxygen decarburization (AOD), ladle treatment (LT), and twin roll strip casting, wherein the AOD comprises: deoxidizing molten steel with silicon (Si), wherein the molten steel has a silicon (Si) content of 0.55 wt % to 0.75 wt % at an end of the AOD, and wherein the duplex stainless steel sheet comprises, by wt %, carbon (C): 0.02% to 0.06%, silicon (Si): 0.55% to 0.75%, manganese (Mn): 2.8% to 3.2%, phosphorus (P): 0.035% or less, sulfur (S): 0.003% or less, chromium (Cr): 19.0% to 21.0%, nickel (Ni): 0.5% to 1.5%, copper (Cu): 0.3% to 1.2%, nitrogen (N): 0.2% to 0.28%, and a balance of iron (Fe) and inevitable impurities.

2. The method of claim 1, wherein in the AOD, slag has a basicity of 2.2 to 2.5.

3. The method of claim 1, wherein the molten steel has a tapping temperature of 1680° C. to 1710° C. in the AOD.

* * * * *